US011944247B2

(12) United States Patent
Zhang et al.

(10) Patent No.: US 11,944,247 B2
(45) Date of Patent: Apr. 2, 2024

(54) MOPPING MEMBER, MOPPING APPARATUS, CLEANING ROBOT, AND CONTROL METHOD FOR CLEANING ROBOT

(71) Applicant: YUNJING INTELLIGENCE INNOVATION (SHENZHEN) CO., LTD., Shenzhen (CN)

(72) Inventors: Junbin Zhang, Dongguan (CN); Weijin Lin, Dongguan (CN)

(73) Assignee: YUNJING INTELLIGENCE INNOVATION (SHENZHEN) CO., LTD., Shenzhen (CN)

( * ) Notice: Subject to any disclaimer, the term of this patent is extended or adjusted under 35 U.S.C. 154(b) by 443 days.

(21) Appl. No.: 17/186,537

(22) Filed: Feb. 26, 2021

(65) Prior Publication Data

US 2021/0177227 A1 Jun. 17, 2021

Related U.S. Application Data

(63) Continuation of application No. PCT/CN2019/101589, filed on Aug. 20, 2019.

(30) Foreign Application Priority Data

Aug. 28, 2018 (CN) ..... 201810987148.7

(51) Int. Cl.
*A47L 11/282* (2006.01)
*A47L 11/40* (2006.01)

(52) U.S. Cl.
CPC ..... *A47L 11/282* (2013.01); *A47L 11/4011* (2013.01); *A47L 11/4038* (2013.01); *A47L 11/4069* (2013.01); *A47L 2201/06* (2013.01)

(58) Field of Classification Search
CPC ..... A47L 11/282; A47L 11/4011; A47L 11/4038; A47L 11/4069; A47L 2201/06;
(Continued)

(56) References Cited

U.S. PATENT DOCUMENTS 8,495,790 B2 7/2013 Forbes et al.
2012/0144620 A1* 6/2012 Forbes ..... A47L 9/0472 15/384
2012/0144621 A1 6/2012 Forbes et al.

FOREIGN PATENT DOCUMENTS

CN 102525339 A 7/2012
CN 106618392 A 5/2017
(Continued)

OTHER PUBLICATIONS

KR 200310249 (Year: 2003).*
WO 2016/159445 (Year: 2016).*
WO 2018/107465 (Year: 2018).*
WO 2018/108144 (Year: 2018).*
(Continued)

*Primary Examiner* — Alexander Markoff

(57) ABSTRACT

Disclosed relates to a mopping member, a mopping apparatus, a cleaning robot, and a control method for the cleaning robot. The mopping member includes a first mop and a second mop; the first mop is provided with a first rotating center, the second mop is provided with a second rotating center, and the distance between the first rotating center and the second rotating center is a rotating center distance. When the first mop and the second mop rotate, a short-diameter edge of one mop corresponds to a long-diameter edge of the other mop; at a connection line position of the first rotating center and the second rotating center, a gap between the first mop and the second mop is formed between the short-diameter edge of one mop and the corresponding long-diameter edge of the other mop.

13 Claims, 10 Drawing Sheets

(58) Field of Classification Search
CPC .... A47L 2201/00; A47L 11/24; A47L 11/283; A47L 11/40
See application file for complete search history.

(56) References Cited

FOREIGN PATENT DOCUMENTS

| | | | |
|---|---|---|---|
| CN | 206586902 | U | 10/2017 |
| CN | 108903847 | A | 11/2018 |
| CN | 209203164 | U | 8/2019 |
| JP | S63200731 | A | 8/1988 |
| JP | H08228974 | A | 9/1996 |
| JP | 2005211363 | A | 8/2005 |
| JP | 2012125582 | A | 7/2012 |
| KR | 200310249 | Y1 | 4/2003 |
| KR | 101576189 | B1 | 12/2015 |
| KR | 101655684 | B1 | 9/2016 |
| WO | 2016159445 | A1 | 10/2016 |
| WO | 2018107465 | A1 | 6/2018 |
| WO | 2018108144 | A1 | 6/2018 |

OTHER PUBLICATIONS

International Search Report and Written Opinion in corresponding PCT Application No. PCT/CN2019/101589, dated Nov. 12, 2019.
Requisition by the Examiner issued in counterpart Canadian Patent Application No. 3, 111, 157, dated Jun. 1, 2022.
Request for the Submission of an Opinion issued in counterpart Korean Patent Application No. 10-2021-7008968, dated Jul. 21, 2022.
Second Notice of Reasons for Refusal issued in counterpart Japanese Patent Application No. 2021-510811, dated Jul. 26, 2022.
Examination Report issued in counterpart British Patent Application GB2102727.1, dated Jan. 19, 2022.
Examination Report No. 1 issued in counterpart Australian Patent Application No. 2019330418, dated Mar. 30, 2022.
Notice of Reasons for Refusal issued in counterpart Japanese Patent Application No. 2021-510811, dated Feb. 25, 2022.
Supplementary European Search Report issued in counterpart European Patent Application No. 19854156.7, dated May 2, 2022.
Written Opinion issued in counterpart Singapore Patent Application No. 11202101961T, dated Dec. 21, 2021.

* cited by examiner

MOPPING MEMBER, MOPPING APPARATUS, CLEANING ROBOT, AND CONTROL METHOD FOR CLEANING ROBOT

CROSS REFERENCE TO RELATED APPLICATIONS

The present disclosure is a Continuation Application of PCT Application No. PCT/CN2019/101589, filed on Aug. 20, 2019, which claims the priority of Chinese Patent Application No. 201810987148.7, filed on Aug. 28, 2018 with the China National Intellectual Property Administration and entitled "MOPPING MEMBER, MOPPING APPARATUS, AND CLEANING ROBOT", the entirety of which is hereby incorporated herein by reference for all purposes.

TECHNICAL FIELD

The present disclosure relates to the technical field of cleaning equipment, and more particularly relates to a mopping member, a mopping apparatus, a cleaning robot, and a control method for a cleaning robot.

BACKGROUND

The statement herein is merely used to provide background information related to the present disclosure, and is not intended to constitute the related art.

As the cleaning field has been developed, more various types of cleaning equipment are available. Many types of cleaning equipment adopt a circular double turntable structure for cleaning, namely, by rotating two mops for cleaning. However, due to processing errors, it is difficult to make the two mops tangent to each other without leaving a gap therebetween. If the mops are relatively small, there generally exists a gap therebetween; if the mops are relatively large, the mops typically squeeze and deform each other, resulting in a gap therebetween. The above-mentioned gap disables the existing cleaning equipment to remove all dust or dirt from an area to be clean at one time. Hence, many types of cleaning equipment must clean the area to be clean several times, so as to remove all the dust or dirt from the area to be clean.

SUMMARY

It is an object of the present disclosure to provide a mopping member, a mopping apparatus, a cleaning robot, and a control method for the cleaning robot, aiming to solve the problem that the existing cleaning equipment cannot remove all dust or dirt from the area to be cleaned at one time.

In one aspect, the present disclosure provides a mopping member, used for a cleaning robot to mop and clean a floor surface, including a first mop and a second mop; the first mop is provided with a first rotating center, and the second mop is provided with a second rotating center; a distance between the first rotating center and the second rotating center is a rotating center distance;

the first mop includes a first long-diameter edge and a first short-diameter edge; a point connecting the first long-diameter edge and the first short-diameter edge is a first endpoint; a distance from any point on the first long-diameter edge to the first rotating center is greater than half of the rotating center distance, and a distance from any point on the first short-diameter edge to the first rotating center is less than half of the rotating center distance; a distance from the first endpoint to the first rotating center is equal to half of the rotating center distance;

the second mop includes a second long-diameter edge and a second short-diameter edge; a point connecting the second long-diameter edge and the second short-diameter edge is a second endpoint; a distance from any point on the second long-diameter edge to the second rotating center is greater than half of the rotating center distance, and a distance from any point on the second short-diameter edge to the second rotating center is less than half of the rotating center distance; a distance from the second endpoint to the second rotating center is equal to half of the rotating center distance;

when the first mop and the second mop are rotated, on a connection line between the first rotating center and the second rotating center, a gap between the first mop and the second mop is formed between the first long-diameter edge and the second short-diameter edge, or formed between the second long-diameter edge and the first short-diameter edge.

In another aspect, the present disclosure provides a mopping apparatus, including a first turntable, a second turntable, and the above mopping member; a side edge of the first turntable and a side edge of the second turntable are configured to be spaced apart; the first mop is fixedly connected to a bottom of the first turntable, and is configured to rotate with the first turntable; the second mop is fixedly connected to a bottom of the second turntable, and is configured to rotate with the second turntable; a rotation axis of the first turntable is configured to pass through the first rotating center, and a rotation axis of the second turntable passes through the second rotating center.

In still another aspect, the present disclosure provides a cleaning robot, including a mopping drive mechanism and the above mopping apparatus; driven by the mopping drive mechanism, the first turntable and the first mop are rotatable with respect to the chassis of the cleaning robot around the rotation axis of the first turntable, and the second turntable and the second mop are rotatable with respect to the chassis of the cleaning robot around the rotation axis of the second turntable.

In still another aspect, the present disclosure provides a control method for a cleaning robot, applied to the cleaning robot, the control method including: driving, by the mopping drive mechanism, the first turntable and the first mop to rotate with respect to the chassis of the cleaning robot around the rotation axis of the first turntable, and driving the second turntable and the second mop to rotate with respect to the chassis of the cleaning robot around the rotation axis of the second turntable; where when the mopping drive mechanism drives the first turntable and the second turntable to rotate, the first turntable and the second turntable are controlled to rotate in opposite rotating directions and at a same rotating speed; and during rotation, the gap between the first mop and the second mop is always formed between the long-diameter edge and the short-diameter edge.

In accordance with the mopping member, the mopping apparatus, the cleaning robot, and the control method for the cleaning robot provided in the present disclosure, the first mop includes a first long-diameter edge and a first short-diameter edge that are connected via a first endpoint. The distance from any point on the first long-diameter edge to the first rotating center is greater than half of the rotating center distance, and the distance from any point on the first short-diameter edge to the first rotating center is less than half of the rotating center distance; the distance from the first endpoint to the first rotating center is equal to half of the rotating center distance. Besides, the second mop includes a second long-diameter edge and a second short-diameter edge that are connected via a second endpoint. The distance from any point on the second long-diameter edge to the second rotating center is greater than half of the rotating center distance, and the distance from any point on the second short-diameter edge to the second rotating center is less than half of the rotating center distance; the distance from the second endpoint to the second rotating center is equal to half of the rotating center distance. As such, when the first mop and the second mop are rotated, the short-diameter edge of one mop corresponds to the long-diameter edge of the other mop. On the connection line between the first rotating center and the second rotating center, the gap between the first mop and the second mop is formed between the short-diameter edge of one mop and the long-diameter edge of the other mop. The gap changes left and right as the first mop and the second mop are rotated. Even if there are processing errors in the first mop and the second mop, the first mop and the second mop when operation can cover the gap in between. Thus, the mops provided in the present disclosure, by rotating, can cover the uncleaned area existed in case of using the traditional two circular mops, thereby improving the cleaning efficiency of the cleaning equipment.

DETAILED DESCRIPTION OF THE EMBODIMENTS

The realizing of the aim, functional characteristics and advantages of the present disclosure are further described in detail with reference to the accompanying drawings and the embodiments. It will be appreciated that the specific embodiments described herein are merely illustrative of the present disclosure and are not intended to limit the present disclosure.

First Embodiment

Please refer to FIGS. 1 to 8, the mopping member provided in the first embodiment of the present disclosure, used for a cleaning robot to mop and clean a floor surface, includes a first mop 1*a* and a second mop 2*a*. The first mop 1*a* is provided with a first rotating center O1, and the second mop 2*a* is provide with a second rotating center O2. A distance between the first rotating center O1 and the second rotating center O2 is a rotating center distance. The rotating center distance is a length of a connection line L between the first rotating center O1 and the second rotating center O2. Hereinafter, the connection line between the first rotating center O1 and the second rotating center O2 is referred to as a rotating center connection line L for short.

In the first embodiment, the first mop 1*a* and the second mop 1*b* are substantially triangular-like.

Figure 1:
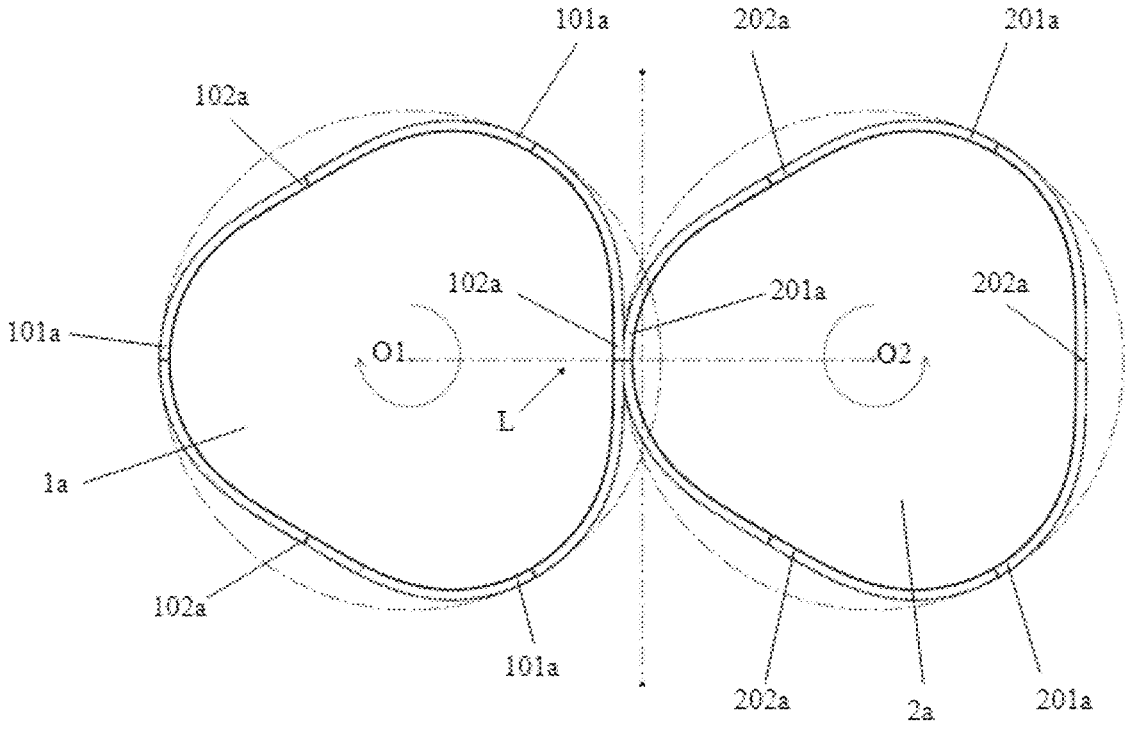
FIG. 1 is a schematic diagram of a mopping member provided in a first embodiment of the present disclosure (triangular-like).

As shown in FIG. 1, the first mop 1*a* includes first long-diameter edges 101*a* and first short-diameter edges 102*a* that are connected via first endpoints 103*a*. The distance from any point on the first long-diameter edge 101*a* to the first rotating center O1 is greater than half of the rotating center distance, and the distance from any point on the first short-diameter edge 102*a* to the first rotating center O1 is less than half of the rotating center distance. The distance from the first endpoint 103*a* to the first rotating center O1 is equal to half of the rotating center distance.

The second mop 2*a* includes second long-diameter edges 201*a* and second short-diameter edges 202*a* that are connected via second endpoints 203*a*. The distance from any point on the second long-diameter edge 201*a* to the second rotating center O2 is greater than half of the rotating center distance, and the distance from any point on the second short-diameter edge 202*a* to the second rotating center O2 is less than half of the rotating center distance. The distance from the second endpoint 203*a* to the second rotating center O2 is equal to half of the rotating center distance.

Figure 2:
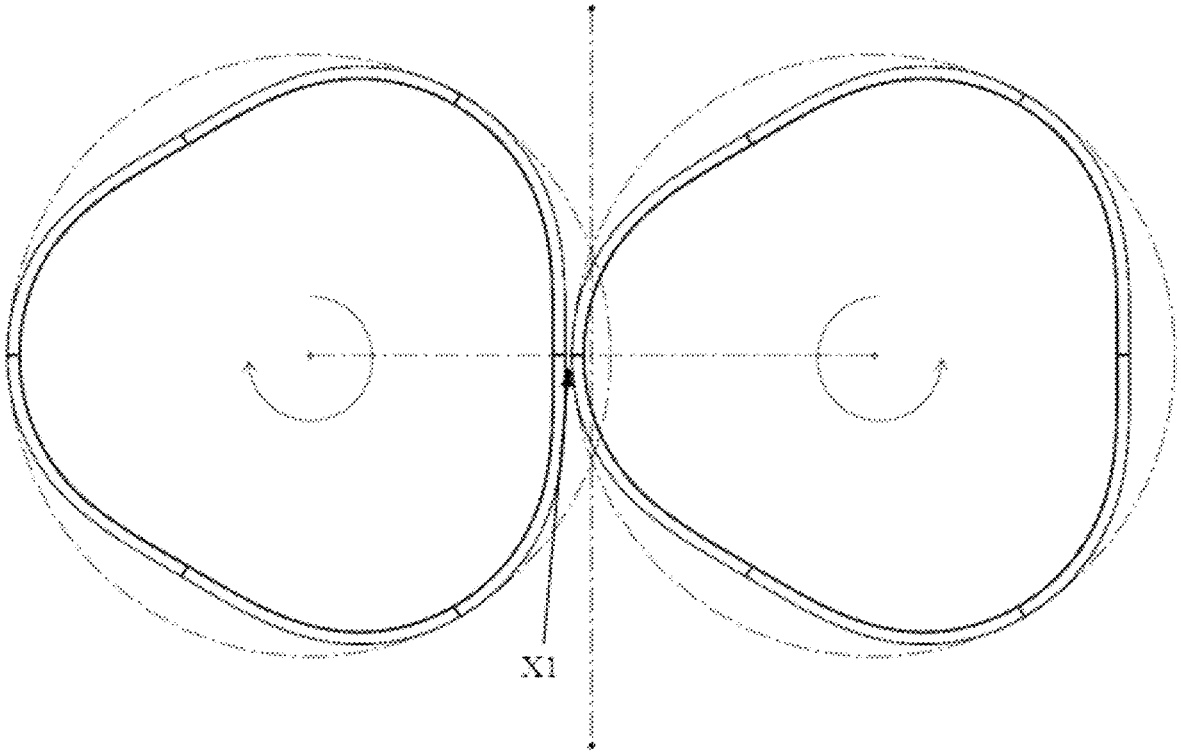
FIG. 2 is a schematic diagram illustrating a width of a gap between a first mop and a second mop of the mopping member provided in the first embodiment being greater than 0 (a connection line between a first rotating center and a second rotating center passes through a point on a first short-diameter edge closest to the first rotating center and a point on a second long-diameter edge farthest from the second rotating center).
Figure 3:
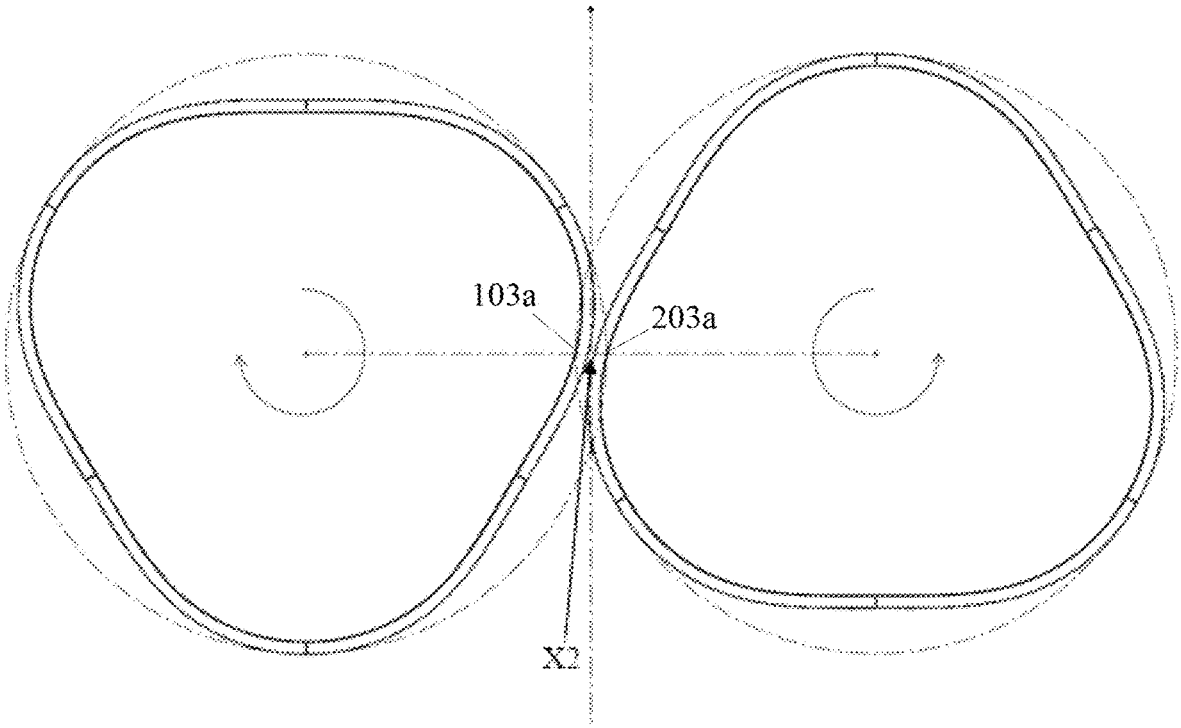
FIG. 3 is a schematic diagram illustrating a width of a gap between a first mop and a second mop of the mopping member provided in the first embodiment being greater than 0 (a connection line between a first rotating center and a second rotating center passes through a first endpoint and a second endpoint).
Figure 4:
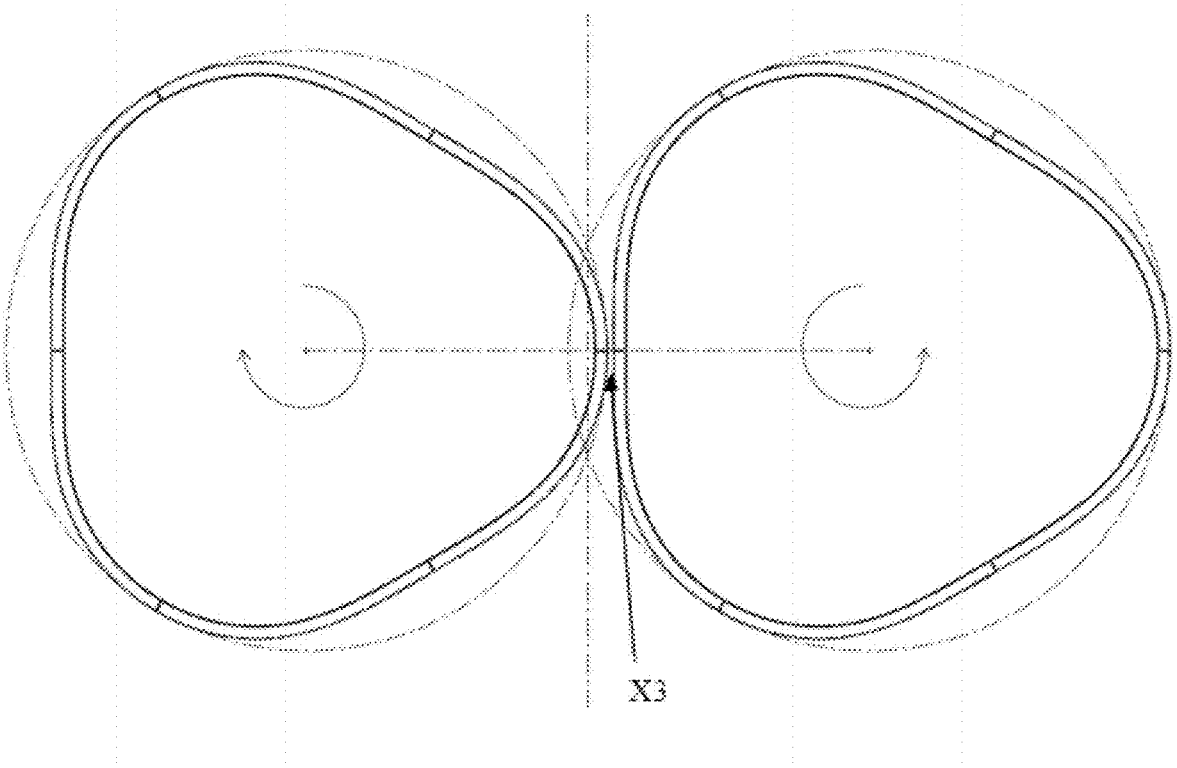
FIG. 4 is a schematic diagram illustrating a width of a gap between a first mop and a second mop of the mopping member provided in the first embodiment being greater than 0 (a connection line between a first rotating center and a second rotating center passes through a point on a second short-diameter edge closest to the second rotating center and a point on a first long-diameter edge farthest from the first rotating center).

As shown in FIGS. 2 to 4, when the first mop 1*a* and the second mop 2*a* are rotated, on the rotating center connection line L, the gap between the first mop 1*a* and the second mop 2*a* is formed between the first long-diameter edge 101*a* and the second short-diameter edge 202*a*, or formed between the second long-diameter edge 201*a* and the first short-diameter edge 102*a*.

FIGS. 2 to 4 are schematic diagrams illustrating gaps of three different angles in case where the width of the gap between the first mop 1*a* and the second mop 2*a* is greater than 0. The gap between the first mop 1*a* and the second mop 2*a* being greater than 0 is typically caused by processing errors. It can be seen from FIGS. 2 to 4 that at a certain moment there exists an uncleaned area caused by the gaps of three different angles. The uncleaned area is an area that has not been cleaned by the mops, generally caused by the gap. FIG. 2 illustrates a state that the rotating center connection line L passes through the point on the first short-diameter edge 102*a* closest to the first rotating center O1 and the point on the second long-diameter edge 201*a* farthest from the second rotating center O2. FIG. 3 illustrates a state that the rotating center connection line L passes through the first endpoint and the second endpoint. FIG. 4 illustrates a state that the rotating center connection line L pass through the point on the second short-diameter edge 202*a* closest to the second rotating center O2 and the point on the first long-diameter edge 101*a* farthest from the first rotating center O1. In the three states shown in FIGS. 2, 3, and 4, the gaps between the first mop 1*a* and the second mop 2*a* are denoted by X1, X2, and X3, respectively.

As shown in FIG. 1, a side contour of the first mop 1*a* and a side contour of the second mop 2*a* are of the same shape. The first mop 1*a* includes a plurality of (here, three) same first long-diameter edges 101*a* and a plurality of (here, three) same first short-diameter edges 102*a*. The plurality of first long-diameter edges 101*a* and the plurality of first short-diameter edges 102*a* are alternately connected. The distance from a point on the first long-diameter edge 101*a* to the first rotating center O1 gradually increases as the point moves from either of two endpoints to the midpoint, and the distance from a point on the first short-diameter edge 102*a* to the first rotating center O1 gradually decreases as the point moves from either of two endpoints to the midpoint. The endpoint here refers to an intersection point of the first long-diameter edge 101*a* and the first short-diameter edge 102*a*, namely the first endpoint described above. In case where the plurality of first long-diameter edges 101*a* and the plurality of first short-diameter edges 102*a* are alternately connected, the two ends of each of the first long-diameter edges 101*a* are respectively the first endpoints, and the two ends of each of the first short-diameter edges 102*a* are respectively the first endpoints.

The second mop 2*a* includes same plurality of (here, three) second long-diameter edges 201*a* and same plurality of (here, three) second short-diameter edges 202*a*. The plurality of second long-diameter edges 201*a* and the plurality of second short-diameter edges 202*a* are alternately connected. The distance from a point on the second long-diameter edge 201*a* to the second rotating center O2 gradually increases as the point moves from either of two endpoints to the midpoint, and the distance from a point on the second short-diameter edge 202*a* to the second rotating center O2 gradually decreases as the point moves from either of two endpoints to the midpoint. The endpoint here refers to an intersection point of the second long-diameter edge 201*a* and the second short-diameter edge 202*a*, namely the second endpoint described above. In case where the plurality of second long-diameter edges 201*a* and the plurality of second short-diameter edges 202*a* are alternately connected, the two ends of each of the second long-diameter edges 201*a* are respectively the second endpoints, and the two ends of each of the second short-diameter edges 202*a* are respectively the second endpoints.

In accordance with this, the point farthest from the first rotating center O1 on the first long-diameter edge 101*a* is the midpoint of the first long-diameter edge 101*a*; the point farthest from the second rotating center O2 on the second long-diameter edge 201*a* is the midpoint of the second long-diameter edges 201*a*; the point closest to the first rotating center O1 on the first short-diameter edge 102*a* is the midpoint of the first short-diameter edge 102*a*; the point closest to the second rotating center O2 on the second short-diameter edge 202*a* is the midpoint of the second short-diameter edge 202*a*.

Figure 5:
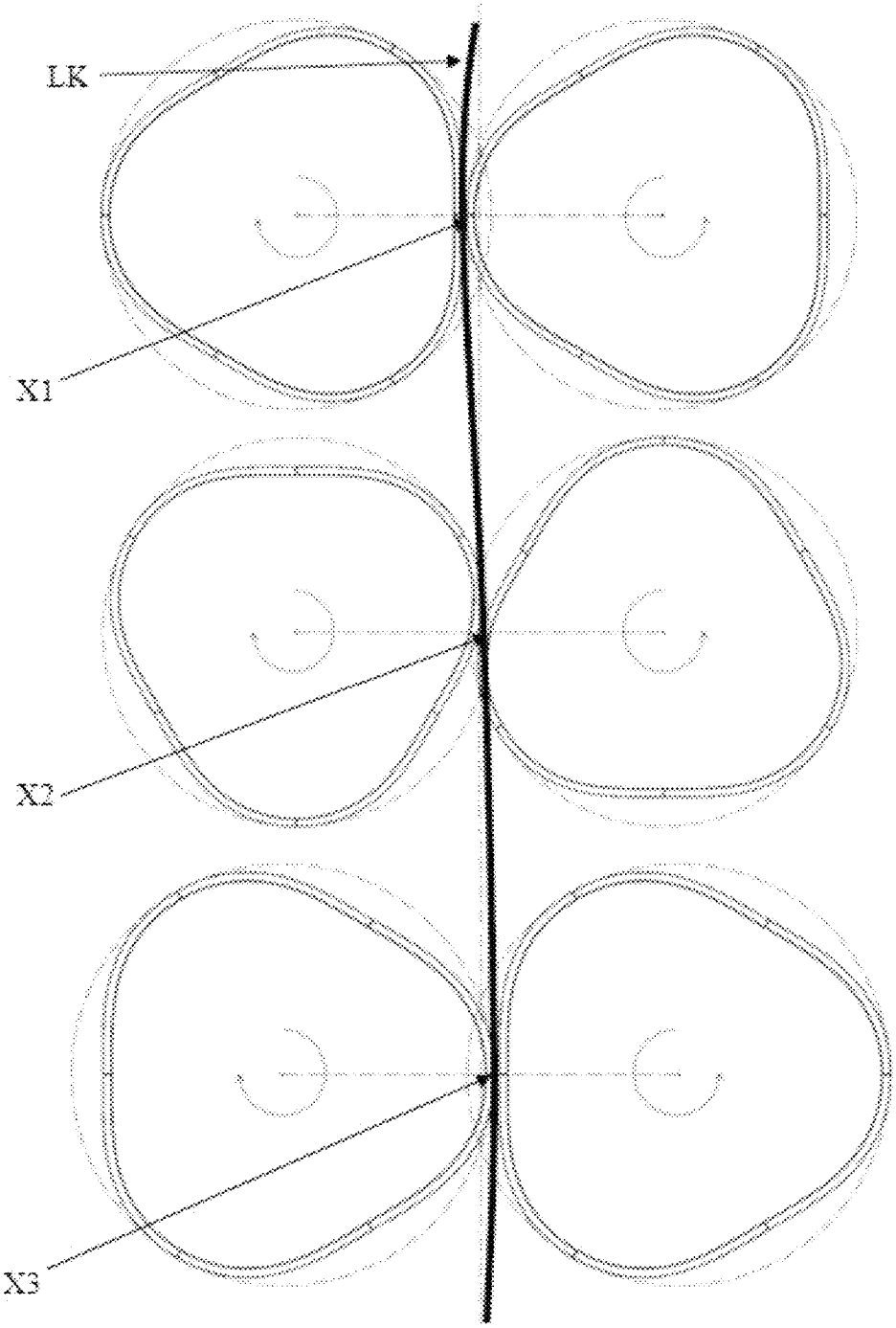
FIG. 5 is a schematic diagram illustrating a contour of gaps between a first mop and a second mop of the mopping member provided in the first embodiment.
Figure 6:
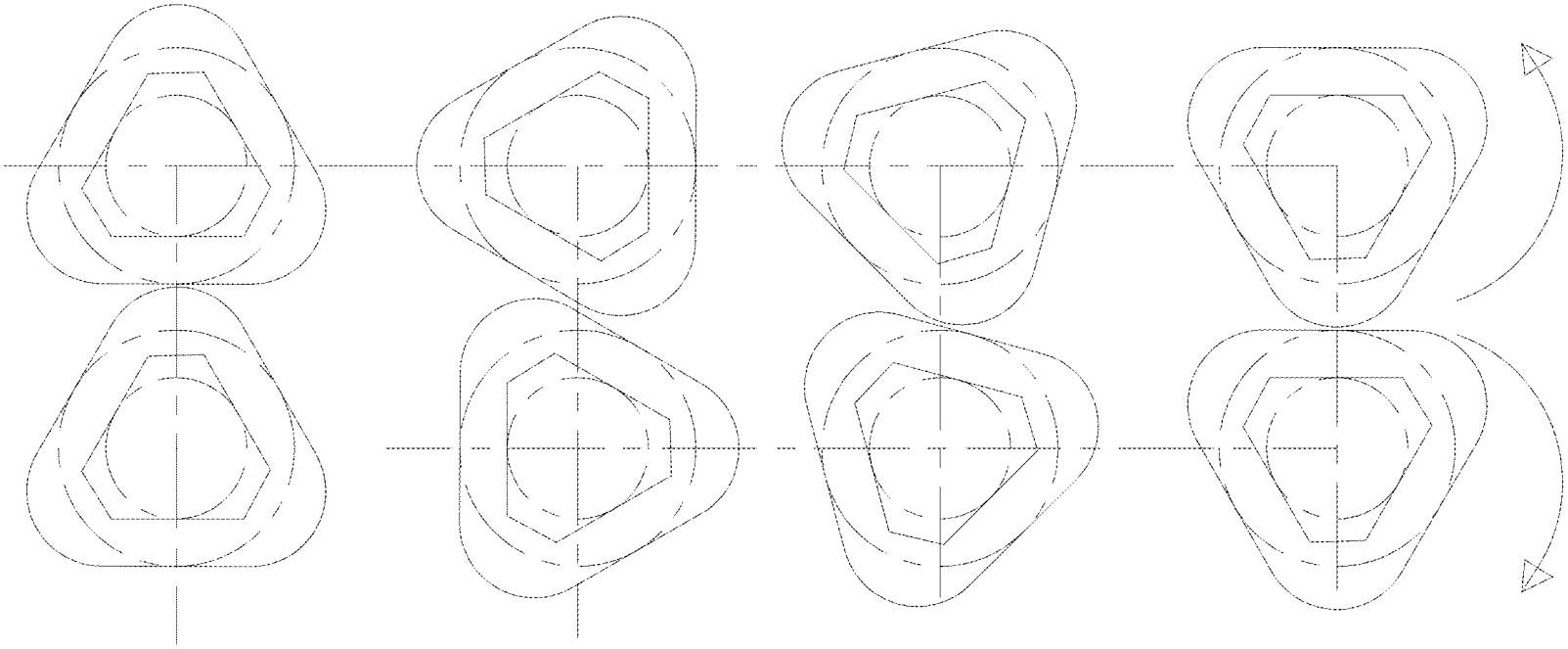
FIG. 6 is a schematic diagram illustrating that a first mop is rotated to a first inserting position and a second mop is rotated to a second inserting position when the first mop and the second mop of the mopping member provided in the first embodiment are rotated.

FIG. 5 is a schematic diagram of a contour of the gaps between the first mop 1*a* and the second mop 2*a* when the two are rotated, where LK in the figure indicates the contour of the gaps. It can be seen that the gap X1 in FIG. 2 can be covered by the first mop 1*a* and the second mop 2*a* in the states shown in FIGS. 3 and 4. Similarly, the gap X2 in FIG. 3 can be covered by the first mop 1*a* and the second mop 2*a* in the states shown in FIGS. 2 and 4. Similarly, the gap X3 in FIG. 4 can be covered by the first mop 1*a* and the second mop 2*a* in the states shown in FIGS. 2 and 3. In operation, since rotation speeds of the first mop 1*a* and the second mop 2*a* are relatively high, usually several to dozens of revolutions per second, the cleaning robot can cover the uncleaned area between the two mops in a very short time, thereby improving the cleaning efficiency.

In addition, it can be seen from FIG. 5 that during the rotations of the first mop 1*a* and the second mop 2*a*, the position of the gap formed between the first mop 1*a* and the second mop 2*a* is constantly changing. Thus, the gap appeared before will be covered in a very short time by the first long-diameter edge 101*a* of the first mop 1*a* or the second long-diameter edge 201*a* of the second mop 2*a* that rotates to the gap later.

Figure 7:
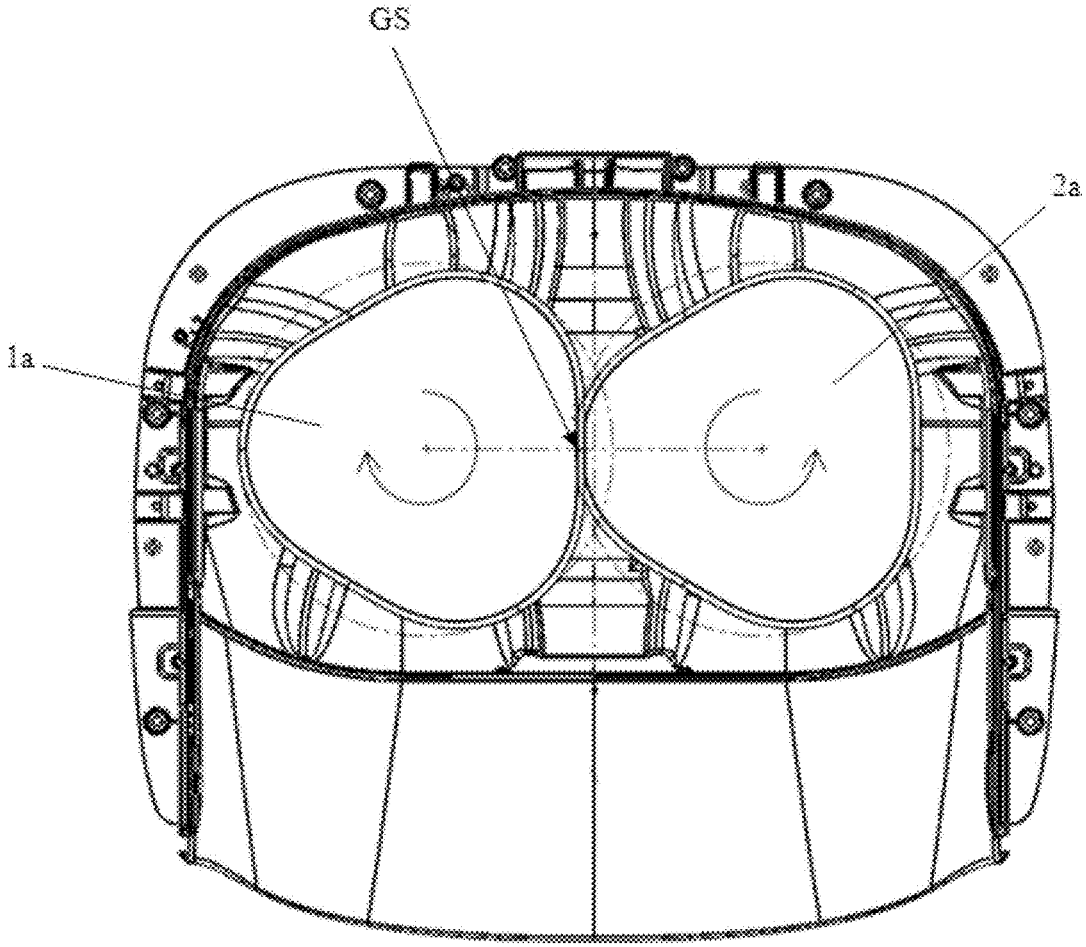
FIG. 7 is a schematic diagram illustrating a width of a gap between a first mop and a second mop of the mopping member provided in the first embodiment being 0, and an interference due to squeezing between the first mop and the second mop (a connection line between a first rotating center and a second rotating center passes through a point on a first short-diameter edge closest to the first rotating center and a point on a second long-diameter edge farthest from the second rotating center).
Figure 8:
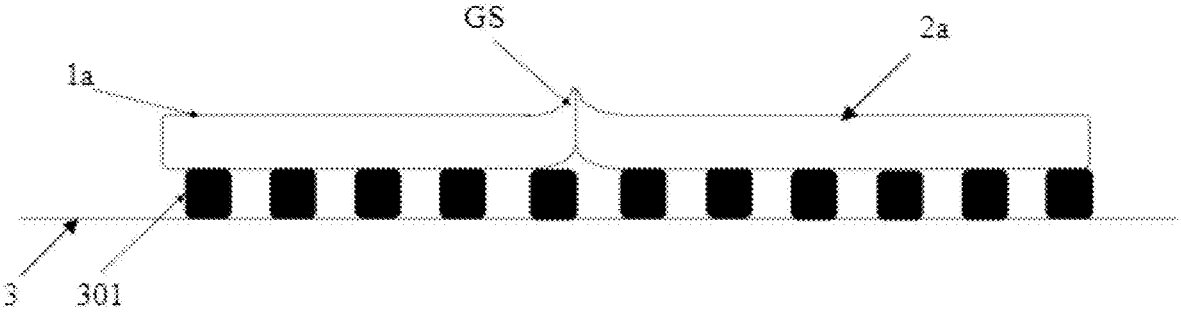
FIG. 8 is a schematic diagram illustrating a working principle that the mopping member provided in the first embodiment performs self-cleaning at a base station.

FIG. 7 is a schematic diagram of the mopping member provided by the first embodiment, where the width of the gap between the first mop and the second mop is 0, and the first mop 1*a* and the second mop 2*a* interfere with each other by squeezing each other. The condition that the gap between the first mop 1*a* and the second mop 2*a* is 0 and there exists the interference is generally caused by the processing errors. However, in operation, the first mop 1*a* and the second mop 2*a* with relatively large sizes due to the processing errors can also cover the uncleaned area therebetween at one time. In addition, as shown in FIG. 8, with the first mop 1*a* and the second mop 2*a* having large processing sizes, when the cleaning robot performs the mop self-cleaning at a base station 3, the self-cleaning of the sides of the first mop 1*a* and the second mop 2*a* can be realized by the interference between the first mop 1*a* and the second mop 2*a*. In FIGS. 7 to 8, the interference area is indicated by GS. As shown in FIG. 8, the base station 3 is provided with cleaning ribs 301, which enhances the cleaning effect of the mops.

Generally, a mechanism is provided for scraping the long-diameter edges and the short-diameter edges of the mops, so as to clean the sides of the mops. However, since the rotation speeds of the mops are high, and a difference between the length of the long-diameter edge and the length of the short-diameter edge is large, the mechanism needs to have a certain deformability and a certain scratch resistance, which results in excessive cost or short life of the mechanism.

In the embodiment of the present disclosure, the rotation speed of the first mop 1*a* is the same as the rotation speed of the second mop 2*a*, the distance from a contact point of the two mops to the first rotating center is different from the distance from the contact point to the second rotating center. For example, the long-diameter edge of one mop is in contact with the short-diameter edge of the other mop. In this case, different linear speeds are generated when the two mops are in contact with each other, thereby producing a speed difference. This helps to improve the cleaning effect. Accordingly, it is a reasonable cleaning approach to use the interference due to the squeezing between the first mop 1*a* and the second mop 2*a* for the self-cleaning of the sides.

In this way, when the first mop and the second mop are self-cleaning at the base station, in case where the sizes of the first mop and the second mop are relatively large, there exists the interference area when they are rotated at the same speed. For example, the long-diameter edge of one mop and the short-diameter edge of the other mop interfere with each other due to the squeezing between the two mops. As such, different linear speeds are produced when they are in contact, which produces the speed difference, thereby realizing the self-cleaning of the sides of the mops.

In some other specific implementations, if there is no design error in the first mop 1*a* and the second mop 2*a*, the width of the gap between the first mop 1*a* and the second mop 2*a* is 0, the first mop 1*a* and the second mop 2*a* just touch each other.

In the first embodiment, a bottom surface of the first mop 1*a* is flush with a bottom surface of the second mop 2*a*.

In some examples, the bottom surface of the first mop 1*a* being flush with the bottom surface of the second mop 2*a* means that the bottom surface of the first mop 1*a* is permanently flush with the bottom surface of the second mop 2*a*. That is, in any working state, the bottom surface of the first mop 1*a* is always flush with the bottom surface of the second mop 2*a*.

In some other examples, the bottom surface of the first mop 1*a* being flush with the bottom surface of the second mop 2*a* means that the bottom surface of the first mop 1*a* is temporally flush with the bottom surface of the second mop 2*a*. That is, in some working states, e.g., when there occurs no relative deflection between the bottom surface of the first mop 1*a* and the bottom surface of the second mop 2*a*, the bottom surface of the first mop 1*a* is flush with the bottom surface of the second mop 2*a*; while when there occurs a relative deflection between the bottom surface of the first mop 1*a* and the bottom surface of the second mop 2*a*, the bottom surface of the first mop 1*a* may not be flush with the bottom surface of the second mop 2*a*.

In the first embodiment, the first long-diameter edge 101*a* is an arc-shaped edge convex about the first rotating center O1, and the first short-diameter edge 102*a* is a straight edge. The second long-diameter edge 201*a* is an arc-shaped edge convex about the second rotating center O2, and the second short-diameter edge 202*a* is a straight edge.

However, in some alternative embodiments of the first embodiment, the first short-diameter edge 102*a* may be an arc-shaped edge convex about the first rotating center O1. Similarly, the second short-diameter edge 202*a* may be an arc-shaped edge convex about the second rotating center O2.

It will be appreciated that although the first embodiment is described by taking the first mop 1*a* and the second mop 2*a* being substantially triangular-like as an example, the side contours of the first mop and the second mop may have other specific shapes. The present disclosure does not limit the side contours of the first mop and the second mop. For instance, the side contours of the first mop and the second mop may have the shape shown in the second embodiment or the third embodiment.

Second Embodiment

Figure 9:
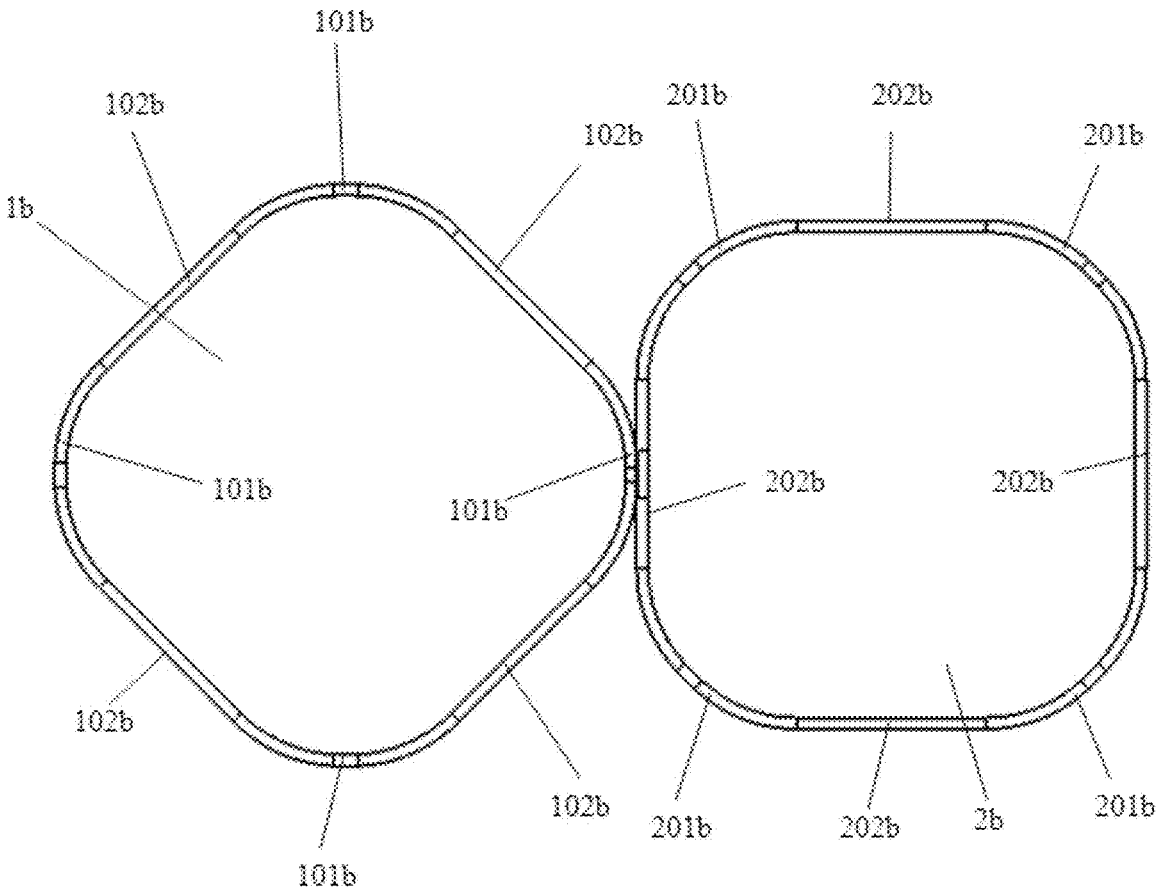
FIG. 9 is a schematic diagram of a mopping member provided in a second embodiment of the present disclosure (quadrilateral-like).

Please refer to FIG. 9, the mopping member provided in the second embodiment of the present disclosure includes a first mop 1*b* and a second mop 2*b*. The first mop 1*b* is provided with a first rotating center O1, and the second mop 2*b* is provide with a second rotating center O2. A distance between the first rotating center O1 and the second rotating center O2 is a rotating center distance. The rotating center distance is a length of a connection line L between the first rotating center O1 and the second rotating center O2. Hereinafter, the connection line between the first rotating center O1 and the second rotating center O2 is referred to as a rotating center connection line L for short.

In the second embodiment, the first mop 1*b* and the second mop 2*b* are substantially quadrilateral-like.

As shown in FIG. 9, the first mop 1*b* includes first long-diameter edges 101*b* and first short-diameter edges 102*b* that are connected via first endpoints. The distance from any point on the first long-diameter edge 101*b* to the first rotating center O1 is greater than half of the rotating center distance, and the distance from any point on the first short-diameter edge 102*b* to the first rotating center O1 is less than half of the rotating center distance. The distance from the first endpoint to the first rotating center O1 is equal to half of the rotating center distance. The second mop 2*b* includes second long-diameter edges 201*b* and second short-diameter edges 202*b* that are connected via second endpoints. The distance from any point on the second long-diameter edge 201*b* to the second rotating center O2 is greater than half of the rotating center distance, and the distance from any point on the second short-diameter edge 202*b* to the second rotating center O2 is less than half of the rotating center distance. The distance from the second endpoint to the second rotating center O2 is equal to half of the rotating center distance.

When the first mop 1*b* and the second mop 2*b* are rotated, on the rotating center connection line L, the gap between the first mop 1*a* and the second mop 2*b* is formed between the first long-diameter edge 101*b* and the second short-diameter edge 202*b*, or formed between the second long-diameter edge 201*b* and the first short-diameter edge 102*b*.

As shown in FIG. 9, a side contour of the first mop 1*b* and a side contour of the second mop 2*b* are of the same shape. The first mop 1*b* includes a plurality of (here, four) same first long-diameter edges 101*b* and a plurality of (here, four) same first short-diameter edges 102*b*. The plurality of first long-diameter edges 101*b* and the plurality of first short-diameter edges 102*b* are alternately connected. The distance from a point on the first long-diameter edge 101*b* to the first rotating center O1 gradually increases as the point moves from either of two endpoints to the midpoint, and the distance from a point on the first short-diameter edge 102*b* to the first rotating center O1 gradually decreases as the point moves from either of two endpoints to the midpoint.

The second mop 2*b* includes a plurality of (here, four) same second long-diameter edges 201*b* and a plurality of (here, four) same second short-diameter edges 202*b*. The plurality of second long-diameter edges 201*b* and the plurality of second short-diameter edges 202*b* are alternately connected. The distance from a point on the second long-diameter edge 201*b* to the first rotating center O1 gradually increases as the point moves from either of two endpoints to the midpoint, and the distance from a point on the second short-diameter edge 202*b* to the first rotating center O1 gradually decreases as the point moves from either of two endpoints to the midpoint.

The mopping member in the second embodiment has the same function as that of the mopping member in the first embodiment. The specific implementation of the mopping member in the second embodiment may refer to the relevant description in the first embodiment. Further, the undescribed parts of the mopping member in the second embodiment may also refer to the detailed description of the mopping member in the first embodiment.

Third Embodiment

Figure 10:
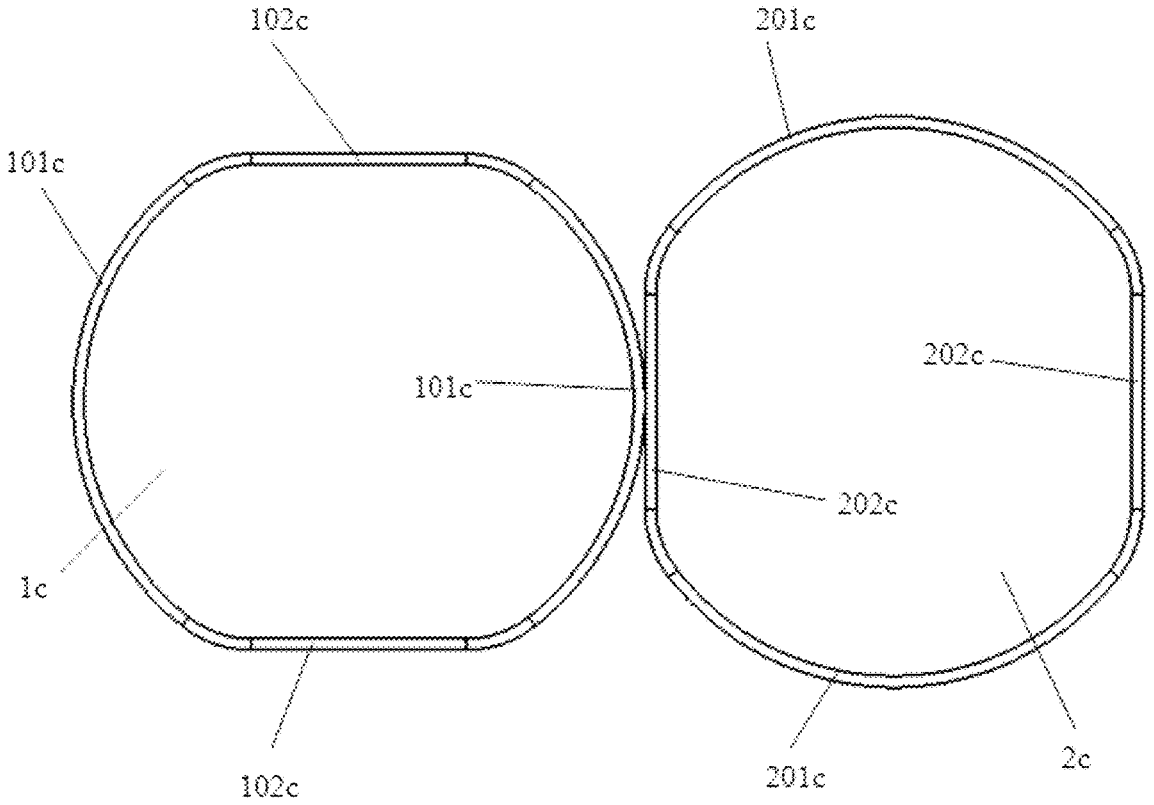
FIG. 10 is a schematic diagram of a mopping member provided in a third embodiment of the present disclosure (oval-like).

Please refer to FIG. 10, the mopping member provided in the second embodiment of the present disclosure includes a first mop 1*c* and a second mop 2*c*. The first mop 1*c* is provided with a first rotating center O1, and the second mop 2*c* is provide with a second rotating center O2. A distance between the first rotating center O1 and the second rotating center O2 is a rotating center distance. The rotating center distance is a length of a connection line L between the first rotating center O1 and the second rotating center O2. Hereinafter, the connection line between the first rotating center O1 and the second rotating center O2 is referred to as a rotating center connection line L for short.

In the third embodiment, the first mop 1*c* and the second mop 1*c* are substantially oval-like.

As shown in FIG. 10, the first mop 1*c* includes first long-diameter edges 101*c* and first short-diameter edges 102*c* that are connected via first endpoints. The distance from any point on the first long-diameter edge 101*c* to the first rotating center O1 is greater than half of the rotating center distance, and the distance from any point on the first short-diameter edge 102*c* to the first rotating center O1 is less than half of the rotating center distance. The distance from the first endpoint to the first rotating center O1 is equal to half of the rotating center distance. The second mop 1*c* includes second long-diameter edges 201*c* and second short-diameter edges 202*c* that are connected via second endpoints. The distance from any point on the second long-diameter edge 201*c* to the second rotating center O2 is greater than half of the rotating center distance, and the distance from any point on the second short-diameter edge 202*d* to the second rotating center O2 is less than half of the rotating center distance. The distance from the second endpoint to the second rotating center O2 is equal to half of the rotating center distance.

When the first mop 1*c* and the second mop 2*c* are rotated, on the rotating center connection line L, the gap between the first mop 1*c* and the second mop 2*c* is formed between the first long-diameter edge 101*c* and the second short-diameter edge 202*c*, or formed between the second long-diameter edge 201*c* and the first short-diameter edge 102*c*.

As shown in FIG. 10, the side contour of the first mop 1*c* and the side contour of the second mop 2*c* are of the same shape. The first mop 1*c* includes same plurality of (here, two) first long-diameter edges 101*c* and same plurality of (here, two) first short-diameter edges 102*c*. The plurality of first long-diameter edges 101*c* and the plurality of first short-diameter edges 102*c* are alternately connected. The distance from a point on the first long-diameter edge 101*c* to the first rotating center O1 gradually increases as the point moves from either of two endpoints to the midpoint, and the distance from a point on the first short-diameter edge 102*c* to the first rotating center O1 gradually decreases as the point moves from either of two endpoints to the midpoint. The endpoint herein refers to the intersection point of the first long-diameter edge 101*c* and the first short-diameter edge 102*c*.

The second mop 2*c* includes a plurality of (here, two) same second long-diameter edges 201*c* and a plurality of (here, two) same second short-diameter edges 202*c*. The plurality of second long-diameter edges 201*c* and the plurality of second short-diameter edges 202*c* are alternately connected. The distance from a point on the second long-diameter edge 201*c* to the first rotating center O1 gradually increases as the point moves from either of two endpoints to the midpoint, and the distance from a point on the second short-diameter edge 202*c* to the first rotating center O1 gradually decreases as the point moves from either of two endpoints to the midpoint. The endpoint herein refers to the intersection point of the second long-diameter edge 201*c* and the second short-diameter edge 202*c*.

The mopping member in the third embodiment has the same function as that of the mopping member in the first embodiment. The specific implementation of the mopping member in the third embodiment may refer to the relevant description in the first embodiment. Further, the undescribed parts of the mopping member in the third embodiment may also refer to the detailed description of the mopping member in the first embodiment.

Fourth Embodiment

The fourth embodiment of the present disclosure provides a mopping apparatus. The mopping apparatus includes a first turntable 5, a second turntable 6, and the mopping member according to any of the embodiments described above.

A side edge of the first turntable 5 and a side edge of the second turntable 6 are arranged to be spaced apart, so that the first turntable 5 and the second turntable 6 are rotated relatively independently without touching each other. The first mop is fixedly connected to the bottom of the first turntable 5, and is configured to rotate with the first turntable 5. The second mop is fixedly connected to the bottom of the second turntable 6, and is configured to rotate with the second turntable 6. The rotation axis of the first turntable 5 is configured to pass through the first rotating center O1, and the rotation axis of the second turntable 6 is configured to pass through the second rotating center O2.

There are various ways to connect the first mop and the first turntable 5, and various ways to connect the second mop and the second turntable 6, such as a detachable connection, or a non-detachable connection. For instance, the ways to connect the first mop and the first turntable 5 and the ways to connect the second mop and the second turntable 6 include, but are not limited to, a glued connection, a bolted connection, a detachable connection through a Velcro provided between the first mop and the first turntable 5, or a snap-fit connection through a button fastener, and so on.

Optionally, in the fourth embodiment, the side contour of the first turntable 5 and the side contour of the first mop are of the same shape, and the side contour of the first turntable 5 falls within the side contour of the first mop. The side contour of the second turntable 6 and the side contour of the second mop are of the same shape, and the side contour of the second turntable 6 falls within the side contour of the second mop. By this way, the first mop and the second mop can be made with a certain range of installation and/or manufacturing errors in case of keeping the first turntable 5 and second turntable 6 out of contact.

In some specific examples, along different rays radiating outward from the first rotating center O1, the distance between the side contour of the first turntable 5 and the side contour of the first mop is equal; along different rays radiating from the second rotating center O2, the distance between the side contour of the second turntable 6 and the side contour of the second mop is equal. As such, the force of the first turntable 5 on the first mop can be more balanced, and the force of the second turntable 6 on the second mop can be more balanced.

Fifth Embodiment

Figure 11:
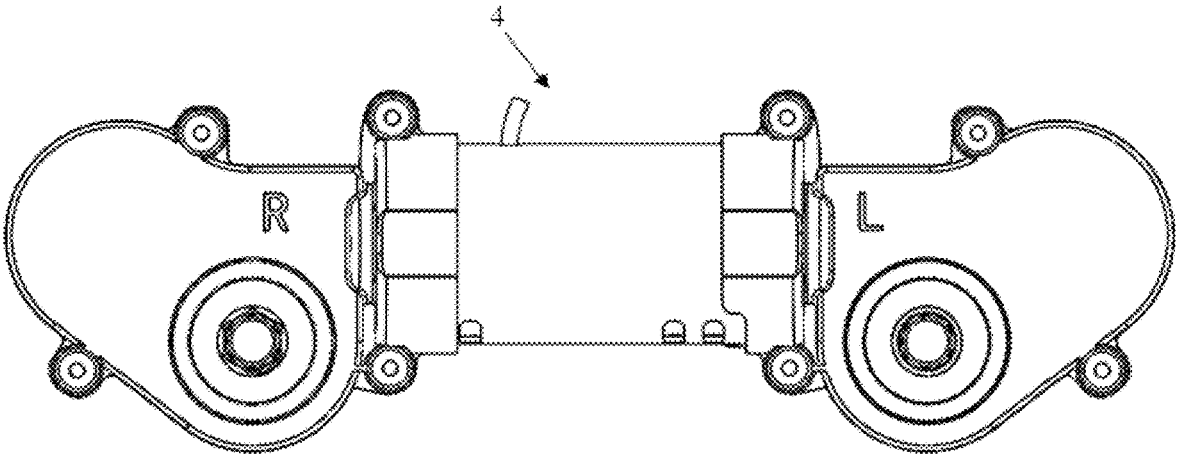
FIG. 11 is a schematic diagram of a mopping drive mechanism of a cleaning robot provided in a fifth embodiment of the present disclosure.
Figure 12:
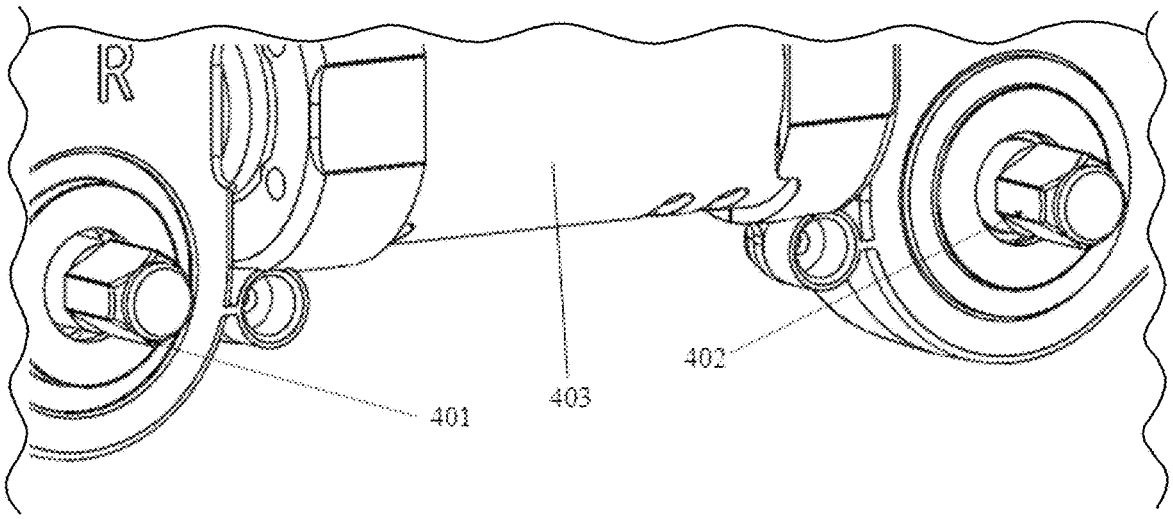
FIG. 12 is a schematic diagram of a first output shaft and a second output shaft of the mopping drive mechanism of the cleaning robot provided in the fifth embodiment.
Figure 13:
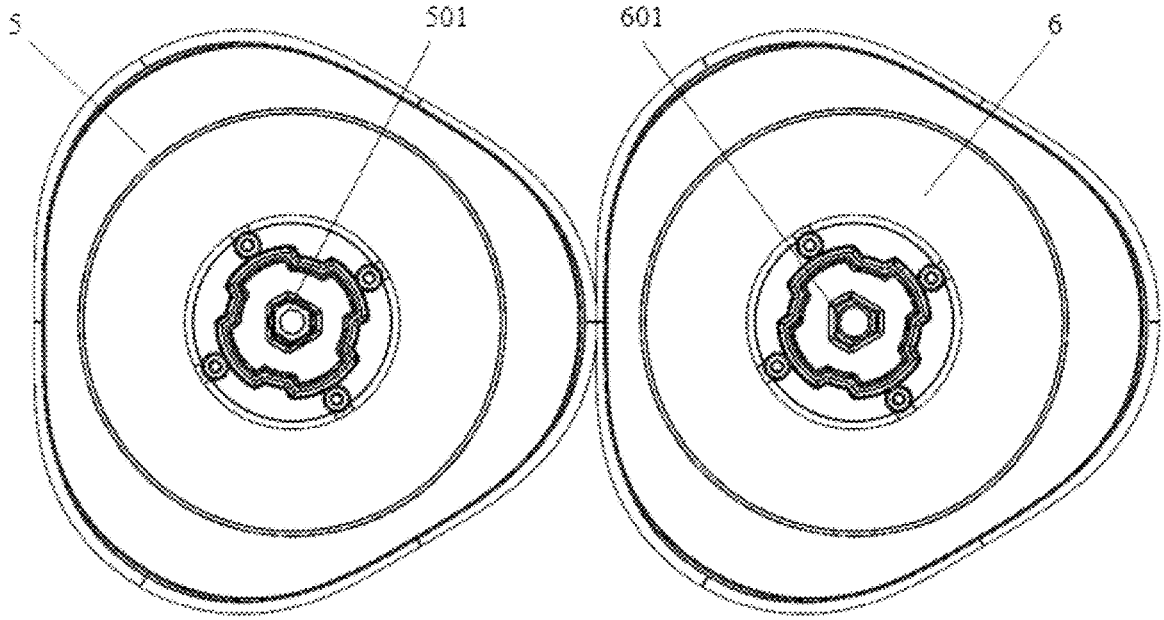
FIG. 13 is a schematic diagram of a mopping apparatus of the cleaning robot provided in the fifth embodiment.

As shown in FIGS. 11 to 13, the cleaning robot provided in the fifth embodiment of the present disclosure includes a mopping drive mechanism 4 and the mopping apparatus according to the fourth embodiment described above. Driven by the mopping drive mechanism 4, the first turntable 5 and the first mop 1*a* can rotate with respect to a chassis of the cleaning robot around the rotation axis of the first turntable 5; the second turntable 6 and the second mop 2*a* can rotate with respect to the chassis of the cleaning robot around the rotation axis of the second turntable 6.

Optionally, in the fifth embodiment, the mopping drive mechanism 4 includes a first output shaft 401 and a second output shaft 402. A lower end of the first output shaft 401 is connected to a position where is the rotating center of the first turntable 5, and a lower end of the second output shaft 402 is connected to a position where is the rotating center of the second turntable 6. The axis of the first output shaft 401 is coincided with the rotation axis of the first turntable 5, and the axis of the second output shaft 402 is coincided with the rotation axis of the second turntable 6.

As shown in FIGS. 11 and 12, the mopping drive mechanism 4 further includes a worm motor 403, a first worm gear drivingly connected to the first output shaft 401, and a second worm gear drivingly connected to the second output shaft 402. The worm motor 403 is configured to output torques. The first worm gear and the second worm gear are both engaged with the worm motor 403, to transmit the torques to the first output shaft 401 and the second output shaft 402. A specific working process is as follows: the torques output by the worm motor 403 are transmitted to the first worm gear and the second worm gear, so as to drive the first worm gear and the second worm gear to rotate; then, the first worm gear drives the first output shaft 401 to rotate, and the second worm gear drives the second output shaft 402 to rotate. The lower end of the first output shaft 401 is connected to the position where is the rotating center of the first turntable 5, and the lower end of the second output shaft 402 is connected to the position where is the rotating center of the second turntable 6. Thus, driven by the mopping drive mechanism 4, the first turntable 5 and the first mop can rotate with respect to the chassis of the cleaning robot around the rotation axis of the first turntable 5, the second turntable 6 and the second mop can rotate with respect to the chassis of the cleaning robot around the rotation axis of the second turntable 6.

As shown in FIG. 13, the first turntable 5 is provided with a first shaft sleeve 501 adapted for the first output shaft 401, so that the first output shaft 401 can be detachably inserted into the first shaft sleeve 501. The first shaft sleeve 501 being adapted for the first output shaft 401 means that the first output shaft 401 can be inserted into the first shaft sleeve 501. An outer peripheral surface of the first output shaft 401 and an inner wall surface of the first shaft sleeve 501 limit each other, so as to limit a relative rotation between the first output shaft 401 and the first shaft sleeve 501. Specifically, a limit surface of the outer peripheral surface of the first output shaft 401 and a limit surface of the inner wall surface of the first shaft sleeve 501 limit each other, thereby limiting the relative rotation between the first output shaft 401 and the first shaft sleeve 501. For example, a cross-section of the outer peripheral surface of the first output shaft 401 and a cross-section of the inner wall surface of the first shaft sleeve 501 are the same preset regular polygon. After the first output shaft 401 is inserted into the first shaft sleeve 501, the outer peripheral surface of the first output shaft 401 is clamped with the inner wall surface of the first shaft sleeve 501; or in operation, the limit surface of the outer peripheral surface of the first output shaft 401 and the limit surface of the inner wall surface of the first shaft sleeve 501 are abutted each other, so as to limit the relative rotation between the first output shaft 401 and the first shaft sleeve 501.

The second turntable 6 is provided with a second shaft sleeve 601 adapted for the second output shaft 402, so that the second output shaft 402 can be detachably inserted into the second shaft sleeve 601. The second shaft sleeve 601 being adapted for the second output shaft 402 means that the second output shaft 402 can be inserted into the second shaft sleeve 601. An outer peripheral surface of the second output shaft 402 and an inner wall surface of the second shaft sleeve 601 limit each other, so as to limit a relative rotation between the second output shaft 402 and the second shaft sleeve 601. Specifically, a limit surface of the outer peripheral surface of the second output shaft 402 and a limit surface of the inner wall surface of the second shaft sleeve 601 limit each other, thereby limiting the relative rotation between the second output shaft 402 and the second shaft sleeve 601. For example, a cross-section of the outer peripheral surface of the second output shaft 402 and a cross-section of the inner wall surface of the second shaft sleeve 601 are the same preset regular polygon. After the second output shaft 402 is inserted into the second shaft sleeve 601, the outer peripheral surface of the second output shaft 402 is clamped with the inner wall surface of the second shaft sleeve 601; or in operation, the limit surface of the outer peripheral surface of the second output shaft 402 and the limit surface of the inner wall surface of the second shaft sleeve 601 are abutted each other, so as to limit the relative rotation between the second output shaft 402 and the second shaft sleeve 601.

There are a plurality of inserting positions for the first output shaft 401 and the first shaft sleeve 501, so that the first turntable 5 and the first mop have a plurality of installation positions with respect to the chassis of the cleaning robot. There are a plurality of inserting positions for the second output shaft 402 and the second shaft sleeve 601, so that the second turntable 6 and the second mop have a plurality of installation positions with respect to the chassis of the cleaning robot. As such, the first mop and the second mop can be installed at a target relative installation position (a correct relative angle). In other words, when the first output shaft 401 is inserted into the first shaft sleeve 501 at any one of the plurality of inserting positions, and the second output shaft 402 is inserted into the second shaft sleeve 601 at any one of the plurality of inserting positions, the first mop and the second mop can be at the target relative installation position. When the first mop and the second mop are at the target relative installation position, on the rotating center connection line L, the gap between the first mop and the second mop is formed between the first long-diameter edge and the second short-diameter edge, or formed between the second long-diameter edge and the first short-diameter edge.

In this way, it can prevent that when the first mop and the second mop are paired, on the rotating center connection line L, the long-diameter edge of one mop corresponds to the long-diameter edge of the other mop, so that the two mops seriously interfere with each other, thereby resulting in a failure of normal operation. Also it can prevent that when the first mop and the second mop are paired, on the rotating center connection line L, the short-diameter edge of one mop corresponds to the short-diameter edge of the other mop, which causes an excessively large gap.

Optionally, the first mop and the second mop are rotational symmetry with a rotation angle of a preset angle. An absolute value of an angle difference between adjacent inserting positions of the plurality inserting positions for the first output shaft 401 and the first shaft sleeve 501 is N times the preset angle; an absolute value of an angle difference between adjacent inserting positions of the plurality inserting positions for the second output shaft 402 and the second shaft sleeve 601 is N times the preset angle; where N is a positive integer. As such, as long as it is ensured that, in an initial configuration, after inserting the first output shaft into the first shaft sleeve and inserting the second output shaft into the second shaft sleeve, the long-diameter edge of one mop corresponds to the short-diameter edge of the other mop on the rotating center connection line L during the rotations of the two mops, users can insert the first output shaft 401 into the first shaft sleeve 501 at any optional inserting position, and insert the second output shaft 402 into the second shaft sleeve 601 at any optional inserting position. For example, the first mop and the second mop are rotational symmetry with the rotation angle of 120 degrees. That is, the first mop coincides with itself as it rotates through 120 degrees, and the second mop coincides with itself as it rotates through 120 degrees. In this case, there are three insertion potions for the first output shaft 401 and the first shaft sleeve 501, and the angle difference between adjacent inserting positions of the three inserting positions for the first output shaft 401 and the first shaft sleeve 501 is 120 degrees. Besides, there are three insertion potions for the second output shaft 402 and the second shaft sleeve 601, and the angle difference between adjacent inserting positions of the three inserting positions for the second output shaft 402 and the second shaft sleeve 601 is 120 degrees.

For example, the first mop and the second mop are rotational symmetry with the rotation angle of 60 degrees. That is, the first mop coincides with itself as it rotates through 60 degrees, and the second mop coincides with itself as it rotates through 60 degrees. In this case, there are six insertion potions for the first output shaft 401 and the first shaft sleeve 501, and the angle difference between adjacent inserting positions of the six inserting positions for the first output shaft 401 and the first shaft sleeve 501 is 60 degrees. Besides, there are six insertion potions for the second output shaft 402 and the second shaft sleeve 601, and the angle difference between adjacent inserting positions of the six inserting positions for the second output shaft 402 and the second shaft sleeve 601 is 60 degrees. In some other embodiments, there are three insertion potions for the first output shaft 401 and the first shaft sleeve 501, and the angle difference between adjacent inserting positions of the three inserting positions for the first output shaft 401 and the first shaft sleeve 501 is 120 degrees. Besides, there are three insertion potions for the second output shaft 402 and the second shaft sleeve 601, and the angle difference between adjacent inserting positions of the three inserting positions for the second output shaft 402 and the second shaft sleeve 601 is 120 degrees. Alternatively or optionally, there are two insertion potions for the first output shaft 401 and the first shaft sleeve 501, and the angle difference between the two inserting positions for the first output shaft 401 and the first shaft sleeve 501 is 180 degrees. Besides, there are two insertion potions for the second output shaft 402 and the second shaft sleeve 601, and the angle difference between the two inserting positions for the second output shaft 402 and the second shaft sleeve 601 is 180 degrees.

In another embodiment, the first mop and the second mop are non-rotational symmetry. The absolute value of the angle difference between adjacent inserting positions of the plurality of inserting positions for the first output shaft 401 and the first shaft sleeve 501 is N times the preset angle, and the absolute value of the angle difference between adjacent inserting positions of the plurality of inserting positions for the second output shaft 402 and the second shaft sleeve 601 is N times the preset angle; where N is a positive Integer. As such, as long as it is ensured that, in an initial configuration, after inserting the first output shaft into the first shaft sleeve and inserting the second output shaft into the second shaft sleeve, the long-diameter edge of one mop corresponds to the short-diameter edge of the other mop on the rotating center connection line L during the rotations of the two mops, users can insert the first output shaft 401 into the first shaft sleeve 501 at any optional inserting position, and insert the second output shaft 402 into the second shaft sleeve 601 at any optional inserting position.

For example, the first mop has one first long-diameter edge and one first short-diameter edge; the second mop has one second long-diameter edge and one second short-diameter edge. The first mop coincides with itself as it rotates through 360 degrees, and the second mop coincides with itself as it rotates through 360 degrees. In this case, there is one inserting position for the first output shaft 401 and the first shaft sleeve 501, and there is one inserting position for the second output shaft 402 and the second shaft sleeve 601. By providing a buckle or other structures on the output shafts 401, 402 or on the shaft sleeves 501, 601, the first output shaft 401 and the first shaft sleeve 501 can have only one inserting position, and the second output shaft 402 and the second shaft sleeve 601 can have only one inserting position.

It will be appreciated that the above embodiment is described by taking the first output shaft 401 being detachably inserted into the first shaft sleeve 501 and the second output shaft 402 being detachably inserted into the second shaft sleeve 601 as an example. However, in some other embodiments, the first output shaft 401 may be connected to the first turntable 5 in other ways, e.g., by welding or threading, and so on; the second output shaft 402 may be connected to the second turntable 6 in other ways, e.g., by welding or threading, and so on.

From above, during the operation of the cleaning robot, a control method for the cleaning robot includes:

driving, by the mopping drive mechanism 4, the first turntable 5 and the first mop 1*a* to rotate around the rotation axis of the first turntable 5 with respect to the chassis of the cleaning robot, and driving the second turntable 6 and the second mop 2*a* to rotate around the rotation axis of the second turntable 6 with respect to the chassis of the cleaning robot.

When the mopping drive mechanism 4 drives the first turntable 5 and the second turntable 6 to rotate, the first turntable 5 and the second turntable 6 are controlled to rotate in opposite rotating directions and at a same rotating speed.

During the rotations, the gap between the first mop 1*a* and the second mop 2*a* is always formed between the long-diameter edge and the short-diameter edge.

In an embodiment, before the mopping drive mechanism 4 drives the first turntable 5 and the second turntable 6 to rotate, the method further includes:

there being a plurality of first inserting positions for the first output shaft 401 and the first shaft sleeve 501, and there being a plurality of second inserting positions for the second output shaft 402 and the second shaft sleeve 601; installing the first mop 1*a* at one of the plurality of first inserting positions, and installing the second mop 2*a* at one of the plurality of second inserting positions; on the connection line between the first rotating center O1 and the second rotating center O2, the gap between the first mop 1*a* and the second mop 2*a* being formed between the first long-diameter edge 101*a* and the second short-diameter edge 202*a*, or the gap between the first mop 1*a* and the second mop 2*a* being formed between the second long-diameter edge 201*a* and the first short-diameter edge 102*a*.

In accordance with the mopping member, the mopping apparatus and the cleaning robot provided in the present disclosure, when the first mop and the second mop are rotated, the short-diameter edge of one mop corresponds to the long-diameter edge of the other mop. On the connection line between the first rotating center and the second rotating center, the gap between the first mop and the second mop is formed between the short-diameter edge of one mop and the corresponding long-diameter edge of the other mop. During the rotations of the two mops, the gap moves left and right. As such, the mops according to the embodiments, by rotating, can cover the uncleaned gap area that existed in case of using the traditional two circular mops, thereby improving the cleaning efficiency of the cleaning equipment.

The foregoing are only illustrative embodiments in accordance with the present disclosure and therefore not intended to limit the patentable scope of the present disclosure. Any equivalent structure or flow transformations that are made taking advantage of the specification and accompanying drawings of the disclosure and any direct or indirect applications thereof in other related technical fields are within the protection scope of the present disclosure.

What is claimed is:

1. A cleaning robot, comprising a mopping drive mechanism and a mopping apparatus; wherein, the mopping apparatus comprises a first turntable, a second turntable, and a mopping member;

a side edge of the first turntable and a side edge of the second turntable are configured to be spaced apart;

the mopping member comprises a first mop and a second mop;

the first mop is provided with a first rotating center, and the second mop is provided with a second rotating center; a distance between the first rotating center and the second rotating center is a rotating center distance;

the first mop comprises a first long-diameter edge and a first short-diameter edge; a point where the first long-diameter edge and the first short-diameter edge are connected is a first endpoint a distance from any point on the first long-diameter edge to the first rotating center is greater than half of the rotating center distance, and a distance from any point on the first short-diameter edge to the first rotating center is less than half of the rotating center distance; a distance from the first endpoint to the first rotating center is equal to half of the rotating center distance;

the second mop comprises a second long-diameter edge and a second short-diameter edge; a point where the second long-diameter edge and the second short-diameter edge are connected is a second endpoint a distance from any point on the second long-diameter edge to the second rotating center is greater than half of the rotating center distance, and a distance from any point on the second short-diameter edge to the second rotating center is less than half of the rotating center distance; a distance from the second endpoint to the second rotating center is equal to half of the rotating center distance;

in a case that the first mop and the second mop are rotated, on a connection line between the first rotating center and the second rotating center, a gap between the first mop and the second mop is formed between the first long-diameter edge and the second short-diameter edge, or formed between the second long-diameter edge and the first short-diameter edge;

the first mop is fixedly connected to a bottom of the first turntable, and is configured to rotate with the first turntable; the second mop is fixedly connected to a bottom of the second turntable, and is configured to rotate with the second turntable; a rotation axis of the first turntable is configured to pass through the first rotating center; and a rotation axis of the second turntable is configured to pass through the second rotating center;

driven by the mopping drive mechanism, the first turntable and the first mop are rotatable with respect to a chassis of the cleaning robot around the rotation axis of the first turntable, and the second turntable and the second mop are rotatable with respect to the chassis of the cleaning robot around the rotation axis of the second turntable;

the mopping drive mechanism comprises a first output shaft and a second output shaft;

the first turntable is provided with a first shaft sleeve adapted for the first output shaft; the first output shaft is detachably inserted in the first shaft sleeve;

the second turntable is provided with a second shaft sleeve adapted for the second output shaft; the second output shaft is detachably inserted in the second shaft sleeve;

the first mop after a rotation is configured to coincide in shape with itself before the rotation in a case that the first mop rotates through a preset angle;

the second mop after a rotation is configured to coincide in shape with itself before the rotation in a case that the second mop rotates through a preset angle;

there are a plurality of first inserting positions for the first output shaft and the first shaft sleeve, and a rotation angle between adjacent first inserting positions is N times the preset angle; and there are a plurality of second inserting positions for the second output shaft and the second shaft sleeve, and a rotation angle between adjacent second inserting positions is N times the preset angle;

wherein N is a positive integer.

2. The cleaning robot according to claim 1, wherein:

a lower end of the first output shaft is connected to a position where is a rotating center of the first turntable, and a lower end of the second output shaft is connected to a position where is a rotating center position of the second turntable;

an axis of the first output shaft is configured to coincide with the rotation axis of the first turntable, and an axis of the second output shaft is configured to coincide with the rotation axis of the second turntable.

3. The cleaning robot according to claim 2, wherein:

an outer peripheral surface of the first output shaft and an inner wall surface of the first shaft sleeve are configured to limit each other, to limit a relative rotation of the first output shaft and the first shaft sleeve; and an outer peripheral surface of the second output shaft and an inner wall surface of the second shaft sleeve are configured to limit each other, to limit a relative rotation of the second output shaft and the second shaft sleeve.

4. The cleaning robot according to claim 3, wherein:

there are a plurality of first inserting positions for the first output shaft and the first shaft sleeve, to allow the first turntable and the first mop to have a plurality of first installation positions with respect to the chassis of the cleaning robot, and there are a plurality of second inserting positions for the second output shaft and the second shaft sleeve, to allow the second turntable and the second mop to have a plurality of second installation positions with respect to the chassis of the cleaning robot, so that the first mop and the second mop is allowed to be at a target relative installation position;

in a case that the first mop and the second mop are at the target relative installation position, on the connection line between the first rotating center and the second rotating center, the gap between the first mop and the second mop is formed between the first long-diameter edge and the second short-diameter edge, or formed between the second long-diameter edge and the first short-diameter edge.

5. A cleaning robot, comprising a mopping drive mechanism and a mopping apparatus;

wherein the mopping apparatus comprises a first turntable, a second turntable, and a mopping member; the mopping member comprises a first mop and a second mop;

the first mop is provided with a first rotating center, and the second mop is provided with a second rotating center; a distance between the first rotating center and the second rotating center is a rotating center distance;

the first mop comprises a first long-diameter edge and a first short-diameter edge; a distance from any point on the first long-diameter edge to the first rotating center is greater than half of the rotating center distance, and a distance from any point on the first short-diameter edge to the first rotating center is less than half of the rotating center distance;

the second mop comprises a second long-diameter edge and a second short-diameter edge; a distance from any point on the second long-diameter edge to the second rotating center is greater than half of the rotating center distance, and a distance from any point on the second short-diameter edge to the second rotating center is less than half of the rotating center distance;

the first mop and the second mop are driven to rotate by the mopping drive mechanism; a gap between the first mop and the second mop is formed between the first long-diameter edge and the second short-diameter edge, or formed between the second long-diameter edge and the first short-diameter edge;

wherein the mopping drive mechanism comprises a first output shaft and a second output shaft;

the first turntable is provided with a first shaft sleeve adapted for the first output shaft; the first output shaft is detachably inserted in the first shaft sleeve;

the second turntable is provided with a second shaft sleeve adapted for the second output shaft; the second output shaft is detachably inserted in the second shaft sleeve;

the first mop after a rotation is configured to coincide in shape with itself before the rotation in a case that the first mop rotates through a preset angle;

the second mop after a rotation is configured to coincide in shape with itself before the rotation in a case that the second mop rotates through a preset angle;

there are a plurality of first inserting positions for the first output shaft and the first shaft sleeve, and a rotation angle between adjacent first inserting positions is N times the preset angle; and there are a plurality of second inserting positions for the second output shaft and the second shaft sleeve, and a rotation angle between adjacent second inserting positions is N times the preset angle;

wherein N is a positive integer.

6. The cleaning robot according to claim 5, wherein a side edge of the first turntable and a side edge of the second turntable are configured to be spaced apart;

the first mop is fixedly connected to a bottom of the first turntable, and is configured to rotate with the first turntable;

the second mop is fixedly connected to a bottom of the second turntable, and is configured to rotate with the second turntable; and driven by the mopping drive mechanism, the first turntable and the first mop are rotatable with respect to a chassis of the cleaning robot around the rotation axis of the first turntable, and the second turntable and the second mop are rotatable with respect to the chassis of the cleaning robot around the rotation axis of the second turntable.

7. The cleaning robot according to claim 6, wherein the first output shaft is configured to insert in the first shaft sleeve and limit the first shaft sleeve, to limit a relative rotation of the first output shaft and the first shaft sleeve; and the second output shaft is configured to insert in the second shaft sleeve and limit the second shaft sleeve, to limit a relative rotation of the second output shaft and the second shaft sleeve.

8. The cleaning robot according to claim 7, wherein:

an outer peripheral surface of the first output shaft and an inner wall surface of the first shaft sleeve are configured to limit each other; and an outer peripheral surface of the second output shaft and an inner wall surface of the second shaft sleeve are configured to limit each other.

9. The cleaning robot according to claim 7, wherein:

a position of the first shaft sleeve is adjustable relative to the first output shaft, to allow a position of the first mop is adjustable relative to the chassis of the cleaning robot, and a position of the second shaft sleeve is adjustable relative to the second output shaft, to allow a position of the second mop is adjustable relative to the chassis of the cleaning robot, so that the gap between the first mop and the second mop is formed between the first long-diameter edge and the second short-diameter edge, or formed between the second long-diameter edge and the first short-diameter edge.

10. A control method for a cleaning robot, applied to the cleaning robot according to claim 1, comprising:

driving, by the mopping drive mechanism, the first turntable and the first mop to rotate with respect to the chassis of the cleaning robot around the rotation axis of the first turntable, and driving the second turntable and the second mop to rotate with respect to the chassis of the cleaning robot around the rotation axis of the second turntable;

wherein, in a case that the mopping drive mechanism drives the first turntable and the second turntable to rotate, the first turntable and the second turntable are controlled to rotate at opposite rotating directions and at a same rotating speed, and during the rotation, the gap between the first mop and the second mop is always formed between a long-diameter edge and a short-diameter edge.

11. The control method according to claim 10, wherein:

the first turntable is provided with a first shaft sleeve adapted for the first output shaft; the first output shaft is detachably inserted in the first shaft sleeve, an outer peripheral surface of the first output shaft and an inner wall surface of the first shaft sleeve are configured to limit each other, to limit a relative rotation of the first output shaft and the first shaft sleeve;

the second turntable is provided with a second shaft sleeve adapted for the second output shaft; the second output shaft is detachably inserted in the second shaft sleeve, an outer peripheral surface of the second output shaft and an inner wall surface of the second shaft sleeve are configured to limit each other, to limit a relative rotation of the second output shaft and the second shaft sleeve; and before the operation of in a case that the mopping drive mechanism drives the first turntable and the second turntable to rotate, the control method further comprises:

there being a plurality of first inserting positions for the first output shaft and the first shaft sleeve, and there being a plurality of second inserting positions for the second output shaft and the second shaft sleeve;

installing the first mop at one of the plurality of first inserting positions, and installing the second mop at one of the plurality of second inserting positions, so that on the connection line between the first rotating center and the second rotating center, the gap between the first mop and the second mop is formed between the first long-diameter edge and the second short-diameter edge, or formed between the second long-diameter edge and the first short-diameter edge.

12. A control method for a cleaning robot, applied to the cleaning robot according to claim 6, comprising:

driving, by the mopping drive mechanism, the first turntable and the first mop to rotate with respect to the chassis of the cleaning robot around the rotation axis of the first turntable, and driving the second turntable and the second mop to rotate with respect to the chassis of the cleaning robot around the rotation axis of the second turntable;

wherein, in a case that the mopping drive mechanism drives the first turntable and the second turntable to rotate, the first turntable and the second turntable are controlled to rotate at opposite rotating directions and at a same rotating speed, and during the rotation, the gap between the first mop and the second mop is always formed between a long-diameter edge and a short-diameter edge.

13. The control method according to claim 12, wherein:

the first turntable is provided with a first shaft sleeve adapted for the first output shaft; the first output shaft is detachably inserted in the first shaft sleeve, an outer peripheral surface of the first output shaft and an inner wall surface of the first shaft sleeve are configured to limit each other, to limit a relative rotation of the first output shaft and the first shaft sleeve;

the second turntable is provided with a second shaft sleeve adapted for the second output shaft; the second output shaft is detachably inserted in the second shaft sleeve, an outer peripheral surface of the second output shaft and an inner wall surface of the second shaft sleeve are configured to limit each other, to limit a relative rotation of the second output shaft and the second shaft sleeve; and before the operation of in a case that the mopping drive mechanism drives the first turntable and the second turntable to rotate, the control method further comprises:

there being a plurality of first inserting positions for the first output shaft and the first shaft sleeve, and there being a plurality of second inserting positions for the second output shaft and the second shaft sleeve;

installing the first mop at one of the plurality of first inserting positions, and installing the second mop at one of the plurality of second inserting positions, so that on the connection line between the first rotating center and the second rotating center, the gap between the first mop and the second mop is formed between the first long-diameter edge and the second short-diameter edge, or formed between the second long-diameter edge and the first short-diameter edge.

* * * * *